US005987851A

United States Patent [19]

O'Connor

[11] Patent Number: 5,987,851

[45] Date of Patent: Nov. 23, 1999

[54] PACKAGING A STRIP OF MATERIAL

[75] Inventor: Lawrence J. O'Connor, Winnipeg, Canada

[73] Assignee: Stac-Pac Technologies Inc., Christchurch, Barbados

[21] Appl. No.: 09/081,826

[22] Filed: May 20, 1998

[51] Int. Cl.[6] ..... B65B 13/20; B65B 61/20; B65B 63/04

[52] U.S. Cl. ..... 53/429; 53/445; 53/436; 53/434; 206/494; 206/524.8; 493/410; 493/413

[58] Field of Search ..... 53/429, 116, 117, 53/434, 513, 520, 527, 436, 445, 135.1, 156, 157; 206/494, 524.8; 493/413, 414, 415, 410, 411, 437, 439, 440, 357, 356, 363

[56] References Cited

U.S. PATENT DOCUMENTS

| | | | |
|---|---|---|---|
| 32,761 | 7/1861 | Elliot . | |
| 1,463,918 | 8/1923 | Borroughs . | |
| 1,985,676 | 12/1934 | Hand . | |
| 2,425,301 | 8/1947 | Browner | 53/436 |
| 2,659,187 | 11/1953 | Barnes | 53/446 |
| 3,245,680 | 4/1966 | Harrison et al. | 493/413 |
| 3,321,889 | 5/1967 | Zubik et al. | 53/527 |
| 3,351,992 | 11/1967 | Carter | 53/429 |
| 3,429,095 | 2/1969 | Huson | 53/436 |
| 3,499,261 | 3/1970 | Hullhorst et al. | 53/436 |
| 3,645,759 | 2/1972 | Heiligman | 53/429 X |
| 3,673,757 | 7/1972 | Willis | 53/429 |
| 3,684,275 | 8/1972 | Schweitzer et al. | 493/413 X |
| 3,729,367 | 4/1973 | Shore et al. | 53/429 |
| 3,739,544 | 6/1973 | Hanemann . | |
| 4,097,039 | 6/1978 | Fischer | 493/413 |
| 4,201,029 | 5/1980 | Lerner et al. | 53/429 |
| 4,240,854 | 12/1980 | Massey et al. | 53/429 X |
| 4,418,514 | 12/1983 | Spann | 53/434 X |
| 4,427,404 | 1/1984 | Yamada . | |
| 4,499,707 | 2/1985 | Desjobert et al. . | |
| 4,512,464 | 4/1985 | Sylvester | 53/429 X |
| 4,547,184 | 10/1985 | Bunch, Jr. . | |
| 4,597,748 | 7/1986 | Wolf . | |
| 4,603,817 | 8/1986 | O'Connor . | |
| 4,716,706 | 1/1988 | Boeckmann . | |
| 4,896,475 | 1/1990 | McAvinew | 53/117 |
| 4,907,397 | 3/1990 | Goodman | 53/157 X |
| 4,941,374 | 7/1990 | Focke | 53/157 X |
| 5,036,977 | 8/1991 | Schofield et al. | 206/389 |
| 5,064,179 | 11/1991 | Martin . | |
| 5,087,140 | 2/1992 | Keeton et al. . | |
| 5,104,366 | 4/1992 | Bunch | 493/414 X |
| 5,177,934 | 1/1993 | Yamamoto | 53/434 X |
| 5,290,226 | 3/1994 | Green, Jr. . | |
| 5,529,564 | 6/1996 | Hediger . | |

FOREIGN PATENT DOCUMENTS

| | | | |
|---|---|---|---|
| B-22983/83 | 5/1984 | Australia . | |
| 383501 | 8/1990 | European Pat. Off. . | |
| 47638 | 3/1982 | Japan | 53/116 |
| 2-182666 | 7/1990 | Japan . | |
| 1555205 | 4/1990 | U.S.S.R. | 53/429 |

*Primary Examiner*—Linda Johnson
*Attorney, Agent, or Firm*—Oliff & Berridge, PLC; Adrian D. Battison

[57] ABSTRACT

A package of a continuous strip of material comprises a plurality of parallel side by side stacks each containing a length of the strip which is folded back and forth such that each folded portion of the stack is folded relative to the next portion about a line transverse to the strip and such that the side edges of the strip portions are aligned. The strip is continuous through each stack and is connected by a splice from the end of one stack to beginning of the next stack. The package is compressed to reduce the height of the stacks and maintained in the compressed condition by an evacuated sealed bag. The preferred package arrangement uses the package for pay off of the strip in the orientation in which it is formed with the bottom of the stacks resting on a support and the package tilted to one side so that the stacks lean against a support surface for stability. The spliced connection portions extend along one end of the package and are folded to take up the difference in height between the compressed condition and the released condition for unfolding. A spacer plate prevents the connection portions from being wrinkled against the end of the package under the compression from the bag.

25 Claims, 11 Drawing Sheets

PACKAGING A STRIP OF MATERIAL

This invention relates to a package of a strip of material and to a method for forming a package of a strip of material.

BACKGROUND OF THE INVENTION

Previously packages of a continuous strip of material have been formed using a technique known as "festooning" in which the strip is folded back and forth to lay a series of strip portions back and forth with each portion being folded relative to the next about a line transverse to the strip. The technique of festooning has been available for many years and is used in packaging many different types of material but particularly material of a fibrous nature such as fabric, non-woven strips and the like. In this technique, the strip is conventionally guided into a receptacle such as a cardboard box while a first reciprocating movement causes portions of the strip to be laid across the receptacle and folded back and forth and a second reciprocating movement causes the positions of the portions to be traversed relative to the receptacle transversely to the portions. Normally the receptacle comprises a rigid rectangular container at least partly of cardboard having a base and four upstanding sides.

The purpose of the festooning method is for packaging the strip for supply to a machine using the strip. Some users prefer the festooned package relative to a wound package of this type of material. The festooned package contains a much greater length of material than a spirally wound pad. The festooned package can simply be located adjacent the machine without the necessity for any driven unwind stand. In addition, both the leading end and the tail end of the package are available at the top of the package so that a series of the packages can be connected lead to tail to act as an extended supply. Yet further, since the material is simply laid into the package, there is less problem with tension control in the material as it is withdrawn from the package, in comparison with larger traverse wound packages where tension control of large packages can be a problem due to the inertia of the package thus requiring a driven unwind stand. There is therefore no need when festooned packages are used for a complex unwind stand which takes up more space than may be available and involves significant cost.

Festooned packages are formed in a stiff container or box to properly enclose and contain the material and within which the material is stored during transportation for maintaining the material against compression and distortion due to the transfer of loads from surrounding packages. The cardboard container thus provides support for other similar stacked containers and prevents the transfer of loads from the stacked packages from causing excessive compression of packages at the bottom of a stack The cardboard containers and the package structures used in the conventional arrangement however have a number of problems.

Firstly the container must be either recycled with the necessity of shipping the cardboard containers in the return direction to the supplier from the end user or they must be discarded, both at considerable expense.

Secondly the cardboard containers simply receive the material without significant compression so that there is wastage of space within the container due to the packaging of air with the material. In addition the conventional package structure does not minimize the amount of air spaces formed in the structure. The transportation costs of the material therefore are significantly increased by the large volume of the material which provides a density which is significantly below the optimum for most efficient transport.

Thirdly the presence of the essential box during formation of the structure provides a restriction to the proper control of the strip as it is laid down since the sides of the box provide limitations to the position and movement of the guide member controlling the strip.

Fourthly it has been noted that the sides of the box which are parallel to the strips as they are laid down do not closely confine the sides of the package structure with the significant danger that the strips can fall down between the edge of the package and the box side.

In addition, the conventional technique for forming the package in which each of the strips slit from a web of supply material is individually packaged at a separate festooning station is slow and requires a large amount of floor space for the large number of stations. Also the large area covered by the stations causes a significant distance to be travelled by the strip from the slitting station to the festooning station with the potential for strip tension problems and damage to the strip.

There remains therefore a significant requirement for a package of this type but the techniques presently available are unsatisfactory for the above reasons leaving opportunity for an improved package structure.

It is known also to supply for example paper or tickets in a continuous strip which is folded back and forth in an accordion manner to form a stack of the strip so that the strip can be pulled out from one end of the stack. However this significantly limits the length of the strip which can be packaged before the stack becomes unstable.

SUMMARY OF THE INVENTION

It is one object of the present invention, therefore, to provide an improved package structure and a method of packaging a strip of material in which the stability of the package can be improved.

According to a first aspect of the invention there is provided a method of supplying a strip of material comprising:

providing a strip of material having a first side edge, a second side edge, a first surface and a second surface;

forming a package of the strip of material having two ends, two sides, a top and a bottom and comprising:

a plurality of stacks of the strip;

each stack comprising a plurality of folded portions of the strip, wherein each portion of the first stack is folded relative to the next portion about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned and parallel to the sides of the package;

the stacks being parallel and arranged side by side so that the fold lines at one end of the stacks are arranged at one end of the package and the fold lines at the other end of the stacks are arranged at the other end of the package;

the strip being continuous through each stack from a bottom and portion of the strip at the bottom of the stack to a top end portion of the strip at the top of the stack;

compressing the package in a direction at right angles to the top and bottom of the package so as to decrease the height of the stacks from a rest height to a compressed height such that the package can be released from the compressed condition for supply of the strip;

after compressing the stacks, connecting by a spliced connecting portion the bottom end portion of each stack to the top end portion of a next adjacent stack, the spliced connecting portion extending along one end of the package;

wherein the spliced connecting portion has a length which is substantially tight along the compressed height of the package such that the length is less than the rest height;

releasing the package from compression for withdrawing the strip from the stacks in turn;

and, as the package is released from compression, causing the length of strip portion necessary to increase the length of the spliced connecting portion to the rest height to be drawn from the top end portion of the next adjacent stack.

Preferably the spliced connecting portion and the top end portion together define a strip portion which has inserted at some position along its length a full turn of twist.

Preferably the package is wrapped with a flexible packaging material comprising a closed bag from which air has been withdrawn which is sealed against ingress of air such that the stacks are maintained in the compressed condition and the stacks are held together by atmospheric pressure on the packaging material.

According to a second aspect of the invention there is provided a method of supplying a strip of material comprising:

providing a strip of material having a first side edge, a second side edge, a first surface and a second surface;

forming a package of the strip of material having two ends, two sides, a top and a bottom and comprising:

a plurality of stacks of the strip;

each stack comprising a plurality of folded portions of the strip, wherein each portion of the first stack is folded relative to the next portion about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned and parallel to the sides of the package;

the stacks being parallel and arranged side by side so that the fold lines at one end of the stacks are arranged at one end of the package and the fold lines at the other end of the stacks are arranged at the other end of the package;

the strip being continuous through each stack from a bottom end portion of the strip at the bottom of the stack to a top end portion of the strip at the top of the stack;

providing a connecting portion for connecting the bottom end portion of each stack, the connecting portion extending along one end of the stack;

compressing the package in a direction at right angles to the top and bottom of the package so as to decrease the height of the stacks from a rest height to a compressed height such that the package can be released from the compressed condition for supply of the strip;

wrapping the package with a flexible packaging material comprising a closed bag from which air has been withdrawn which is sealed against ingress of air such that the stacks are maintained in the compressed condition and the stacks are held together by atmospheric pressure on the packaging material;

and providing a spacer member between the end of the package and the connecting portion, the spacer member having a flat surface facing outwardly of the side of the package for contacting the connecting portion so that the connecting portion is maintained flat when the package is compressed.

According to a third aspect of the invention there is provided a method of supplying a strip of material comprising:

providing a strip of material having a first side edge, a second side edge, a first surface and a second surface;

forming a package of the strip of material having two ends, two sides, a top and a bottom and comprising:

a plurality of stacks of the strip;

each stack comprising a plurality of folded portions of the strip, wherein each portion of the first stack is folded relative to the next portion about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned and parallel to the sides of the package;

the stacks being parallel and arranged side by side so that the fold lines at one end of the stacks are arranged at one end of the package and the fold lines at the other end of the stacks are arranged at the other end of the package;

the strip being continuous through each stack from a bottom end portion of the strip at the bottom of the stack to a top end portion of the strip at the top of the stack;

connecting by a spliced connecting portion the bottom end portion of each stack to the top end portion of a next adjacent stack, the spliced connecting portion extending along one end of the stack;

compressing the package in a direction at right angles to the top and bottom of the package so as to decrease the height of the stacks from a rest height to a compressed height such that the package can be released from the compressed condition for supply of the strip:

releasing the package from compression for withdrawing the strip from the stacks in turn;

the spliced connecting portion being arranged such that, as the package is released from compression, a length of strip portion necessary to increase the length of the spliced connecting portion to the rest height is drawn from two overlying strip portions;

wherein there is provided a slip sheet between the two overlying strip portions arranged to reduce friction between the two overlying strip portions to allow relative sliding movement between the two overlying strip portions as the package expands.

Preferably the slip sheet is arranged underneath a second strip portion from the top to allow relative sliding movement of the top two strip portions relative to the rest of the package as the package expands.

BRIEF DESCRIPTION OF THE DRAWINGS

Embodiments of the invention will now be described in conjunction with the accompanying drawings in which.

DETAILED DESCRIPTION

A first example of a package according to the invention is shown in FIGS. 1 to 5, where the package comprises a generally rectangular body 10 formed from a strip or sheet 11 of a pliable material to be packaged and generally this material will be of a fibrous nature formed by woven or non-woven material although this is not essential to the package structure. Many materials of various thicknesses can be packaged using the technique as described herein provided the materials can accept the creasing necessary at the end of each folded strip portion. The strip has a width greater than its thickness so as to define two generally flat surfaces and two side edges. The strip is preferably of constant width but not necessarily so.

Figure 2:
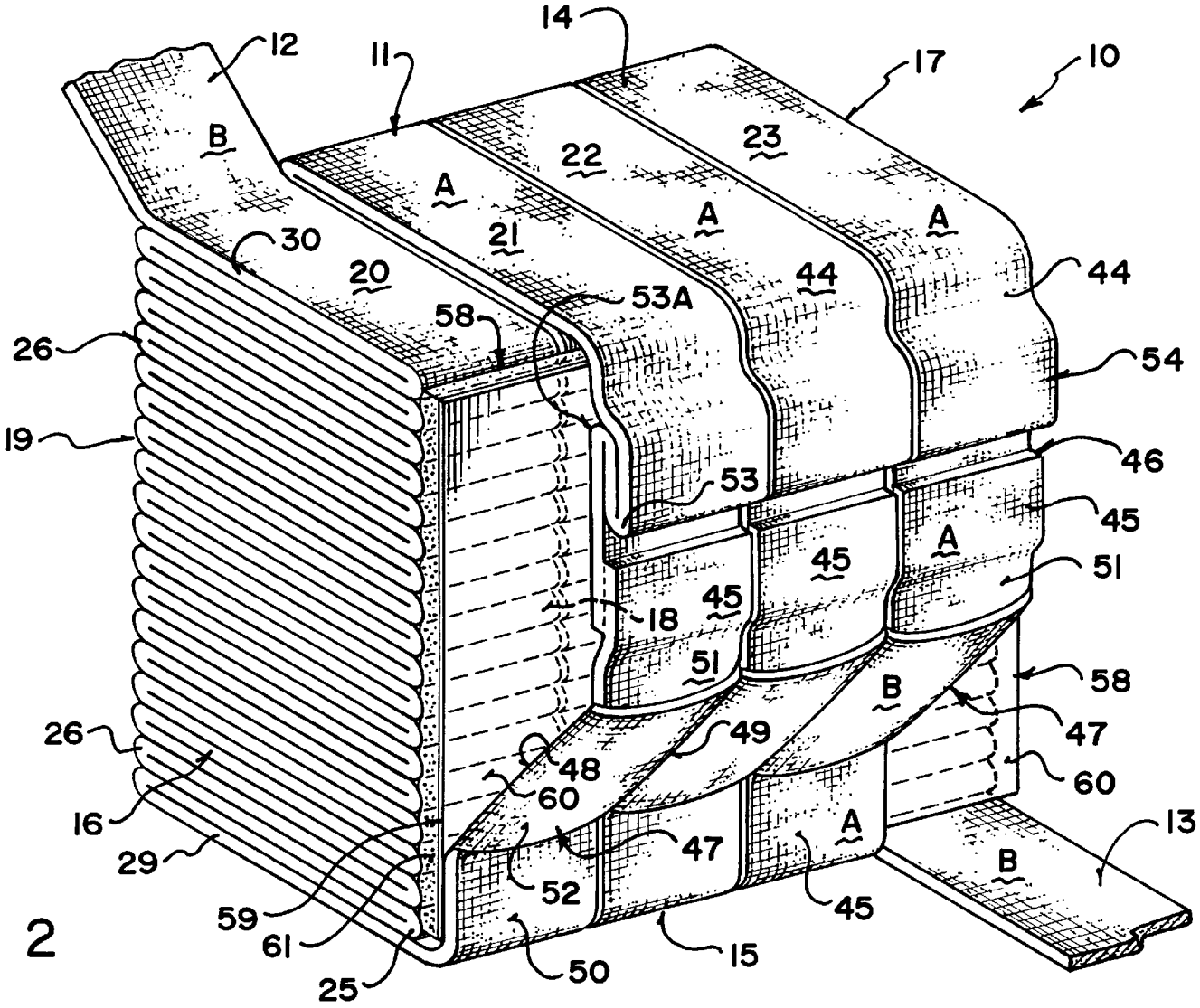
FIG. 2 is a schematic isometric view of the package of FIG. 1 with the connections between the stacks made and the package compressed but with the flexible packaging material omitted for convenience of illustration.

As shown in FIG. 2, where a finished package for use in an end machine is shown, the strip has a leading end 12 and a trailing end 13 of the package and otherwise is continuous through the package. The package when oriented in its normal position for transportation or use as shown in FIG. 2 has a top 14, a bottom 15, two sides 16 and 17 and two ends 18 and 19.

The package is formed by a plurality of stacks of strips. In the embodiments shown there are four stacks of the strip indicated respectively at 20, 21, 22 and 23. The stacks are parallel and directly side by side with no intervening elements. The stacks are parallel to the sides 16, 17. The package has end stacks 20 and 23 and a plurality (in this embodiment two) of intermediate stacks.

The term "stack" as used herein is not intended to require that the stacks be vertical or that any particular orientation of the stacks is required. While the stacks are normally formed by placing the strips each on top of the previous to form a generally upright stack, this is not essential to the construction.

It will be appreciated that the dimensions of the package can of course be varied in accordance with the requirement so that the number of stacks, the length of each stack and the height of each stack can be varied within wide limits.

Figure 1:
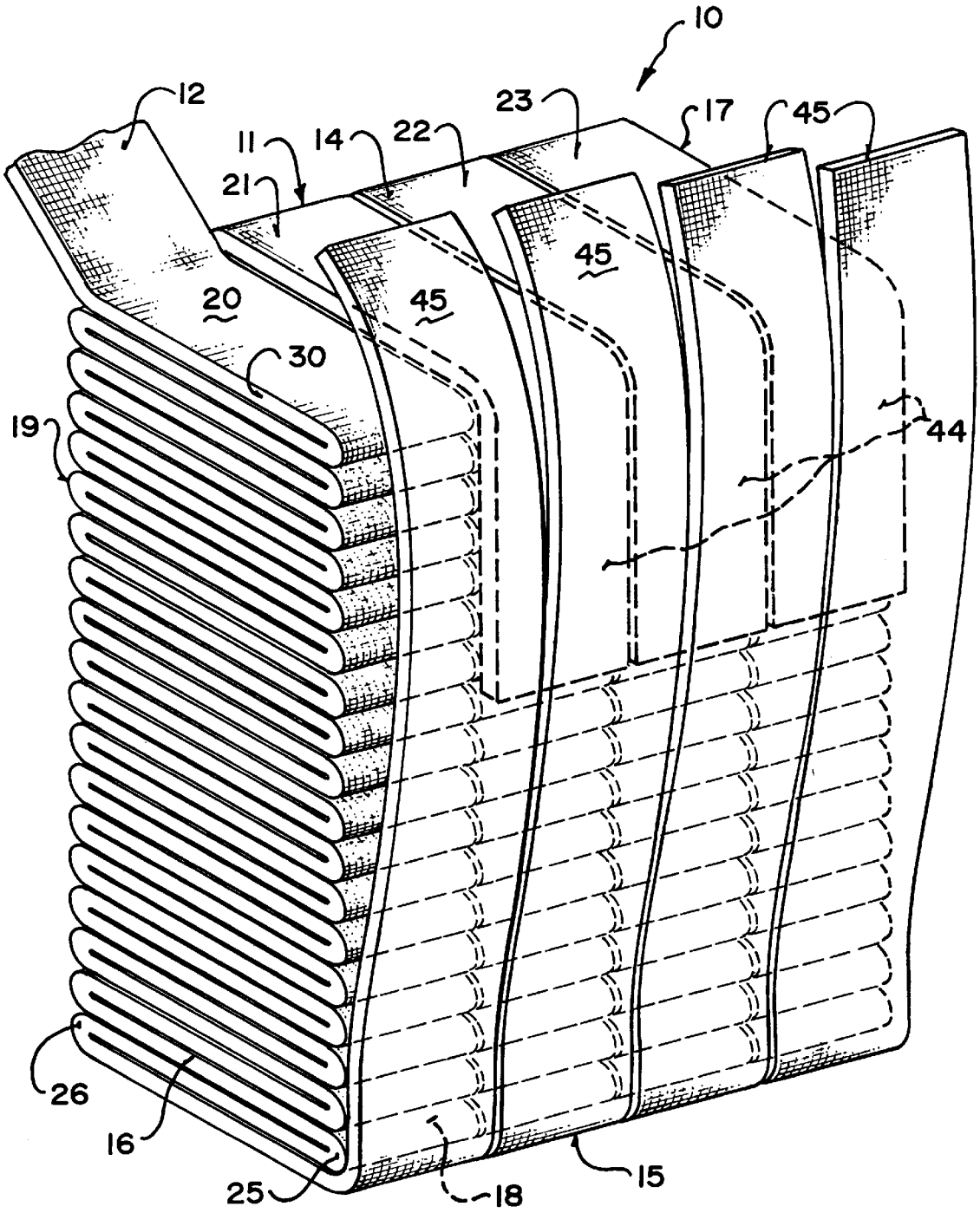
FIG. 1 is a schematic isometric view of a package of a strip according to the present invention, the package including four stacks of the strip and being shown prior to connection of the strip from each stack to the next, prior to compression of the stacks and with the flexible packaging material omitted for convenience of illustration.
Figure 3:
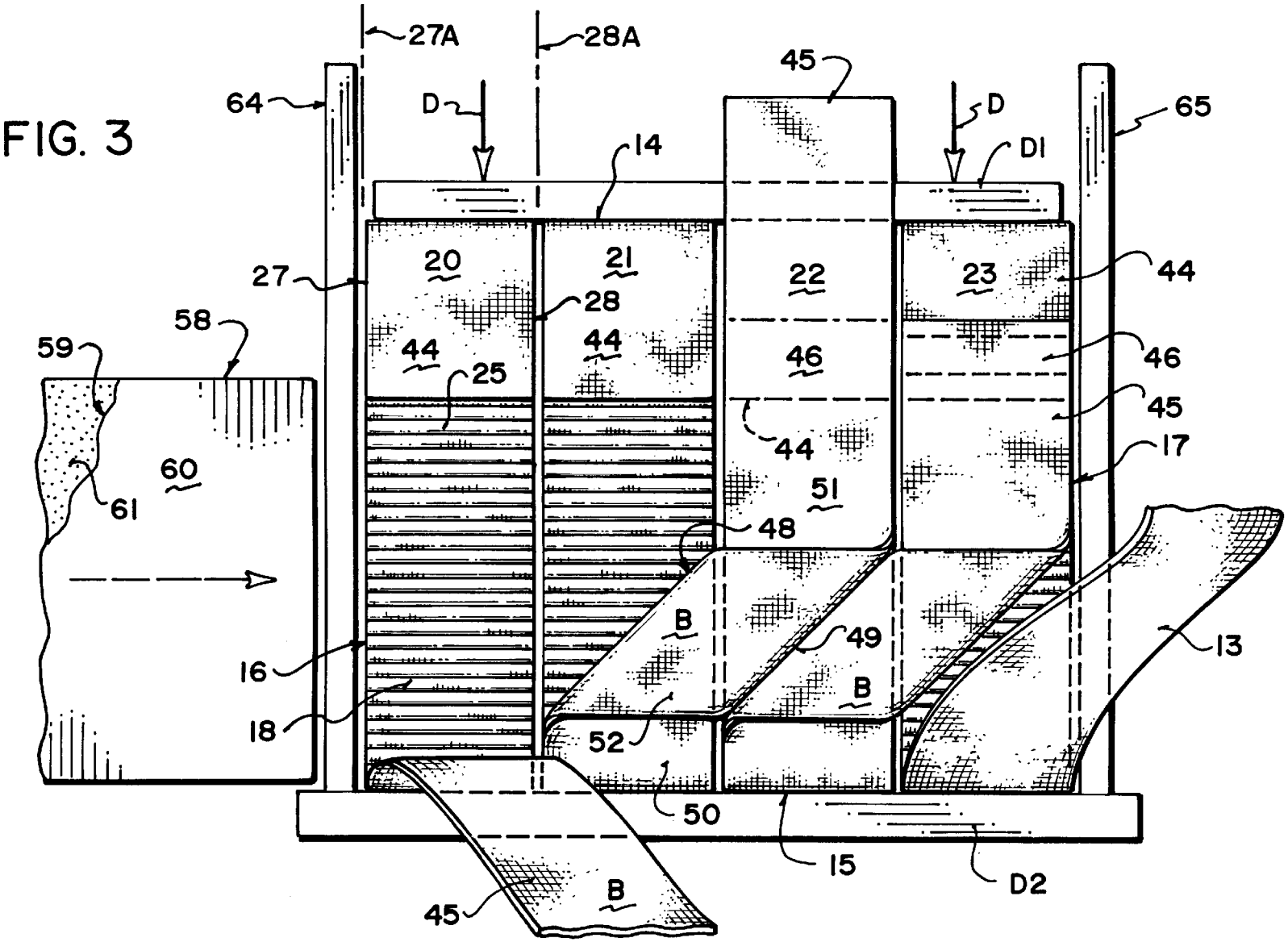
FIG. 3 is a front elevational view of the package of FIGS. 1 and 2 showing the package with the connections partly made prior to compression. This figure includes spaces between the layers but these are merely for convenience of illustration and do not exist in practise.

Each stack of the strip comprises a plurality of portions of the strip which are laid on top of one another. Thus as shown in FIG. 1 the portions are folded back and forth to form accordion folded sheets at respective end fold lines 25 and 26 so that the fold lines lie in a common vertical plane defining the ends 18 and 19 of the package. Each portion of the strip lies directly on top of the previous portion so that, with the strip being of constant width. As shown in FIG. 3, the side edges 27 and 28 of the portions of the strip lie in common vertical planes 27A. The side edges 27 of the strips of the stacks are therefore aligned and the side edges 28 of the strips of the stacks are also aligned.

Thus the package is formed by laying the portions each on top of the next from a bottom portion 29 up to a top portion 30 to form the stack. The package is thus formed from the plurality of stacks each of which has a length in the direction of the strip portions from which it is formed equal to that of the other stacks and therefore equal to that of the package; and the stacks are formed up to a common height which is therefore equal to the height of the package.

Figure 4:
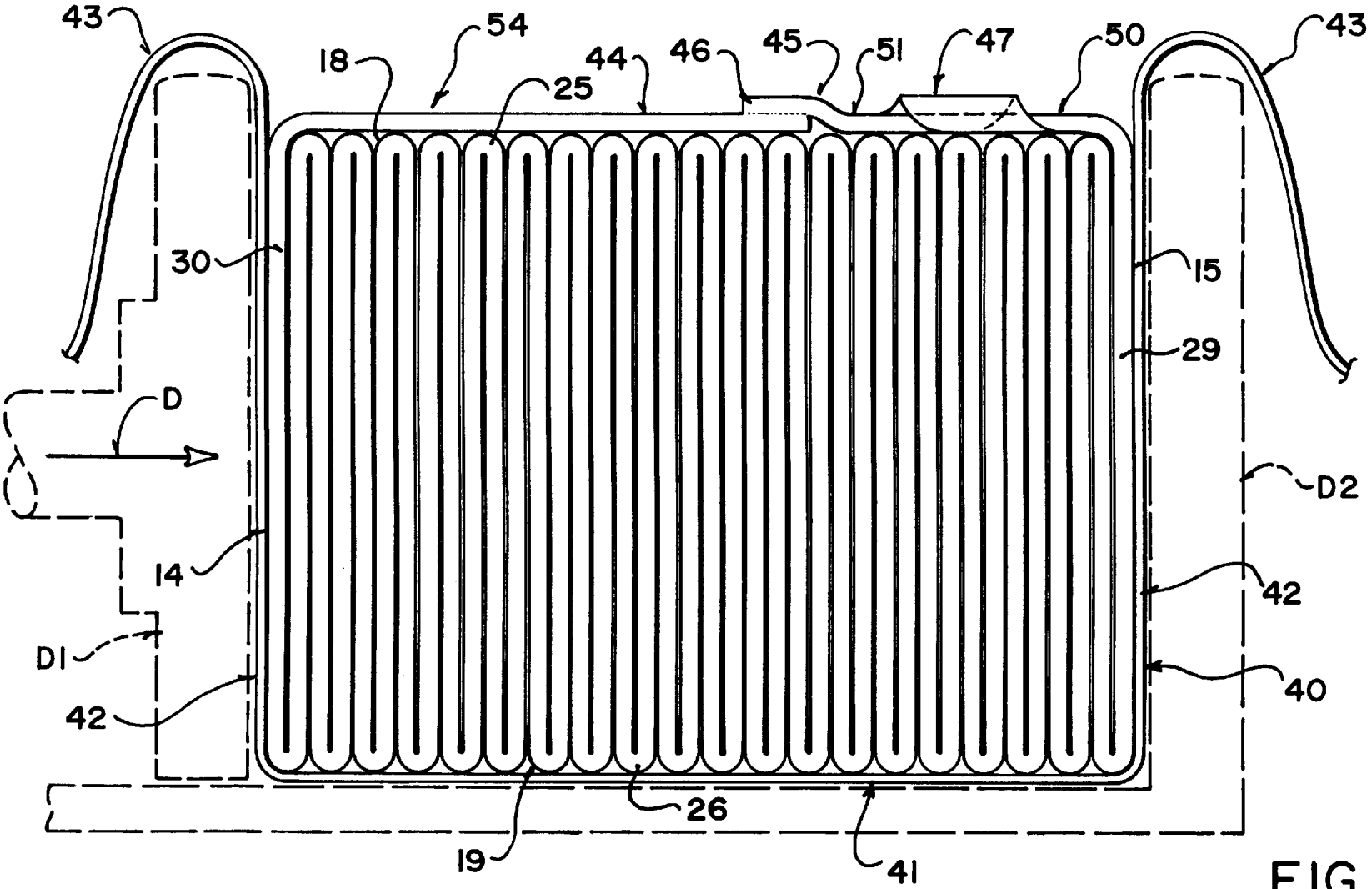
FIG. 4 is a side elevational of the package structure of FIG. 3 showing the bag in place but cut away, prior to compression and rotated through 90 degrees so that the side with the connections is at the top.
Figure 5:
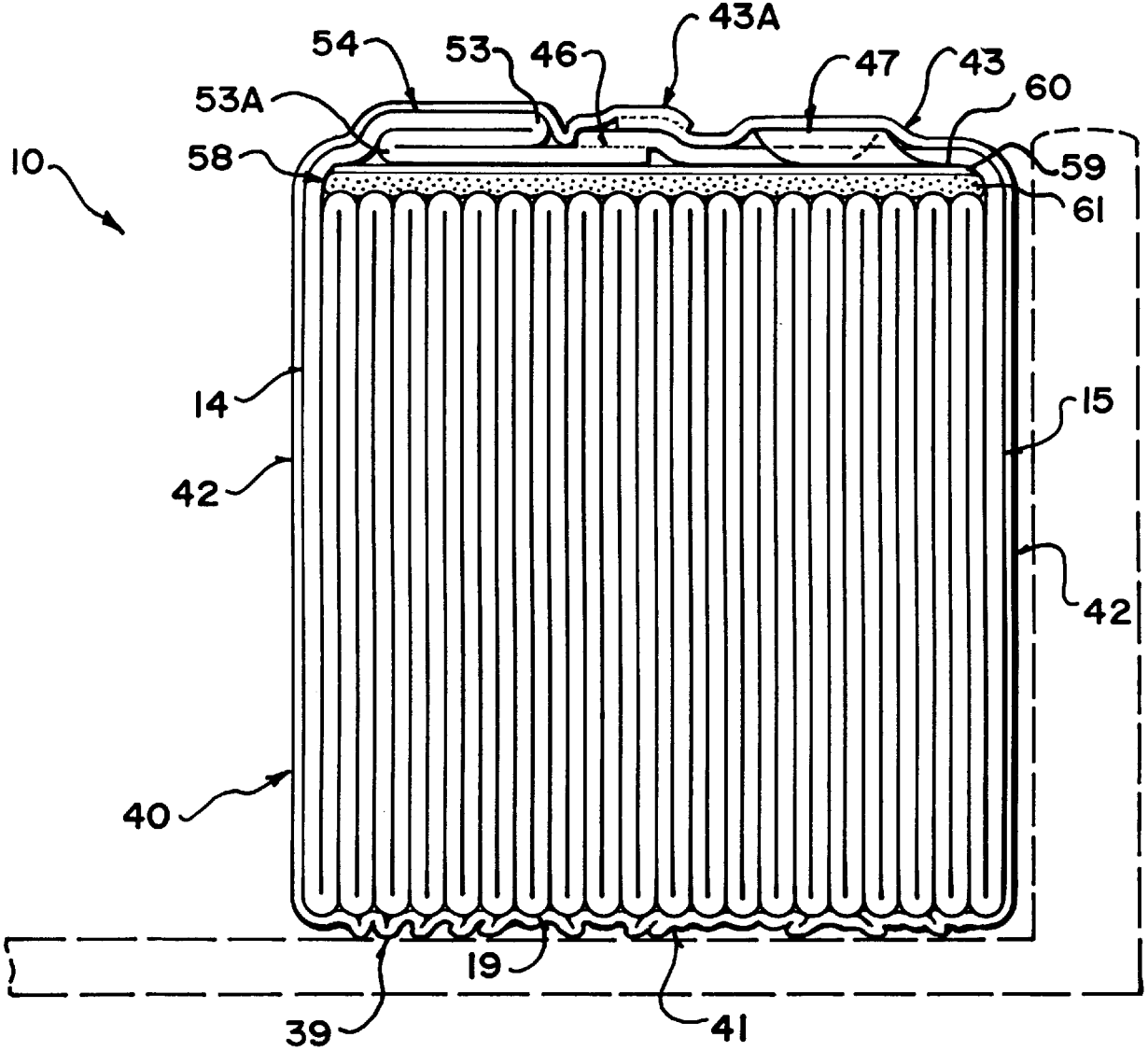
FIG. 5 is the same cross-sectional view as that of FIG. 4 showing the package compressed and the bag closed.

As shown in FIGS. 4 and 5 but omitted from FIG. 2 for convenience of illustration, the package is wrapped with a flexible packaging material 40 preferably of heat sealable non-permeable plastics which encompasses the whole of the package. The packaging material is preferably formed as a bag which includes a base 41 and sides 42 with an open top 43 to be closed and wrapped over the package and heat sealed as indicated in FIG. 5 at 43A. The package is compressed from the ends 14 and 15 to significantly reduce the height of the package and this compression causes air to be extracted or expelled from the package. The sealed bag is used in a vacuum packaging system to maintain the air outside the bag so that the air pressure outside the bag acts to maintain the package compressed in the height direction and maintains the stacks in contact side by side. The amount of compression and thus the amount of height reduction can be determined so as to minimize the volume of the package without interfering with the required loft of the product when withdrawn from the package. The package defined solely by the stacks and the sealed bag thus defines a free standing rigid structure. In this way the package structure avoids the necessity for rigid sides of a box or similar container so the package structure is stable due to the compression of the stacks to reduce the height of the stacks and due to the pressure of each stack against the sides of the next adjacent stacks.

The flexible packaging material is not necessarily a bag but can be a simple wrapping. The use of vacuum to hold the wrapping in place and the stack compressed is preferred but not essential.

Compression of the package is only possible in the direction D which is at right angles to the surfaces of the portions of the strip. This acts to compress the thickness of the portions so that the dimension of each stack in the direction D is reduced by that compression. Compression along the portions or at right angles to the stacks is not possible since this will act to distort the strip. Mechanical compression therefore of the package in the direction D by clamping plates D1 and D2 thus reduces the dimension of the package in that direction allowing the air to be withdrawn from the flexible packaging material 40 causing the packaging material to be pulled down onto the package to maintain it in its compressed condition and to apply pressures tending to hold the stacks in intimate contact.

In the rest condition of the packaging material as shown in FIG. 4, the base 41 of the packaging material or bag 40 is shaped and dimensioned so as to be slightly larger than the rest or uncompressed condition of the package structure itself. In this way the package structure can be readily inserted into the formed plastics packaging material or bag and can remain in place held by the packaging material. During transportation and storage the package structure is in the compressed and vacuumed condition. In this condition the sides 42 of the packaging material are both compressed in the direction D so as to form wrinkles or creases 39. When the vacuum is released, however, the expansion of the package from its compressed condition to its normal relaxed condition will cause the bag to expand to its initial dimensions thus causing the creases 44 to be extracted.

Figure 11:
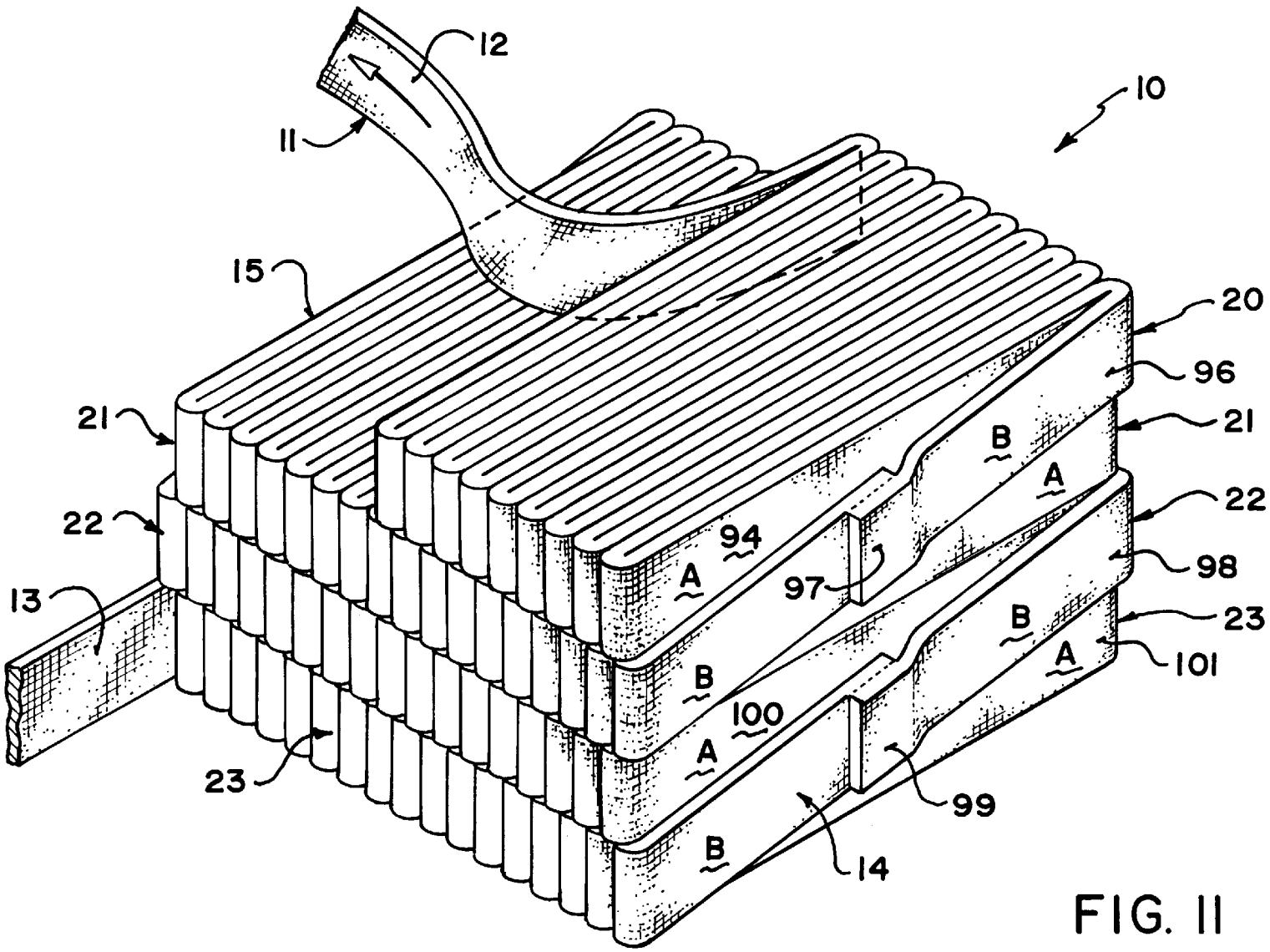
FIG. 11 is an isometric view of a package according to the present invention showing the package after release of the compression with the strip partly unfolded for use and with the bag omitted for convenience of illustration.

The package can be oriented as shown in FIG. 2 which is the same orientation as it is formed by laying the strip portions horizontally to build up the stacks vertically as stacks. In this orientation, the top of the bag is at the top of the package. In the orientation shown in FIGS. 4 and 5, the package is rotated through 90 degrees so that one end 18 is at the top. This can be done but is not necessary but is not necessary to assist splicing as discussed hereinafter. In this orientation, the top of the bag is located at the end of the package. Also the package can be rotated so the one side is at the top as shown in FIG. 11. In all these orientations the package is stable when wrapped so that it can be transported and handled using conventional lifting and handling systems, stacked on pallets or stacked on top of other packages.

Figure 9:
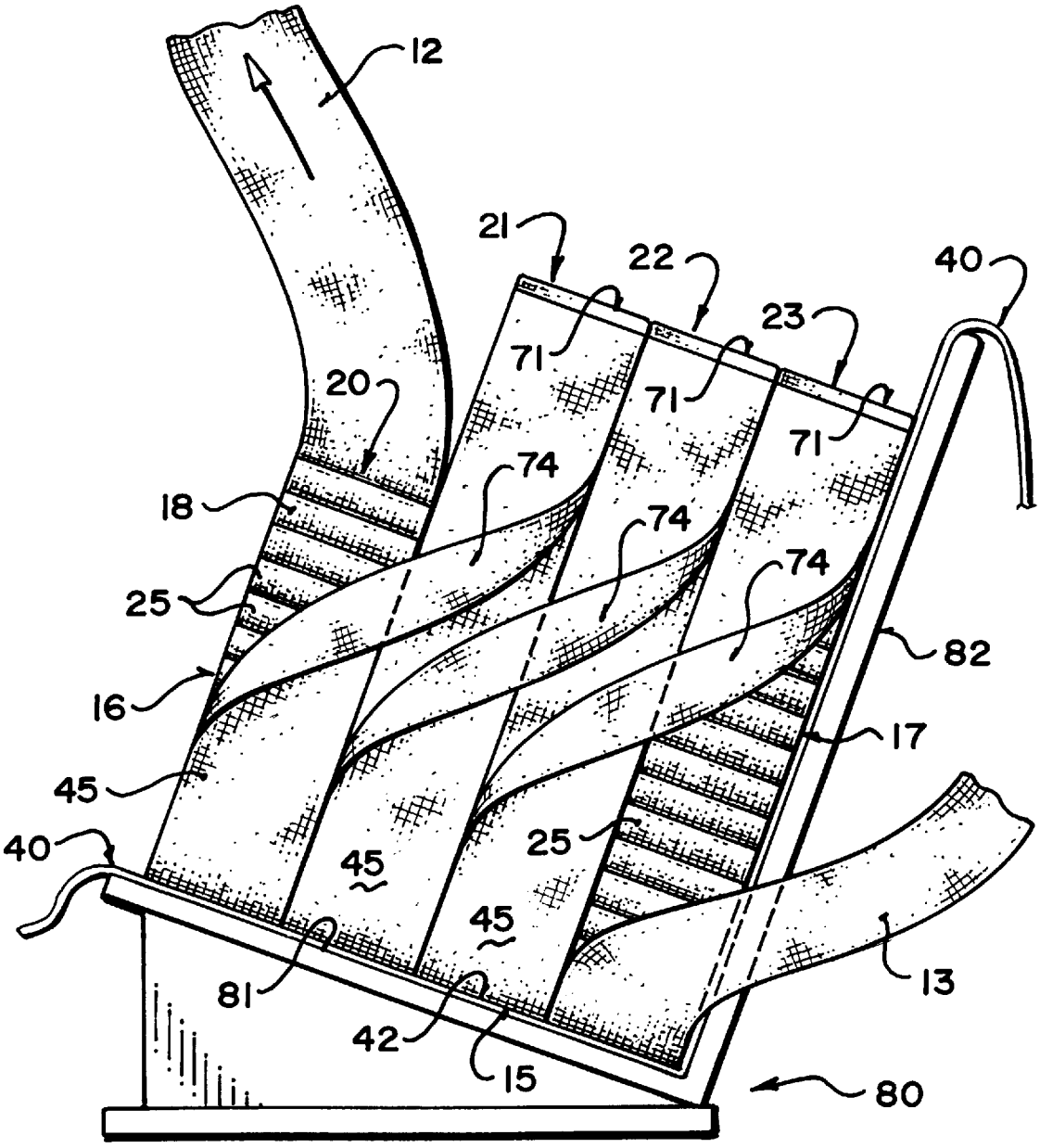
FIG. 9 is an end elevational view of package as shown in FIG. 8 with the compression released and the strip partly unfolded for use.
Figure 10:
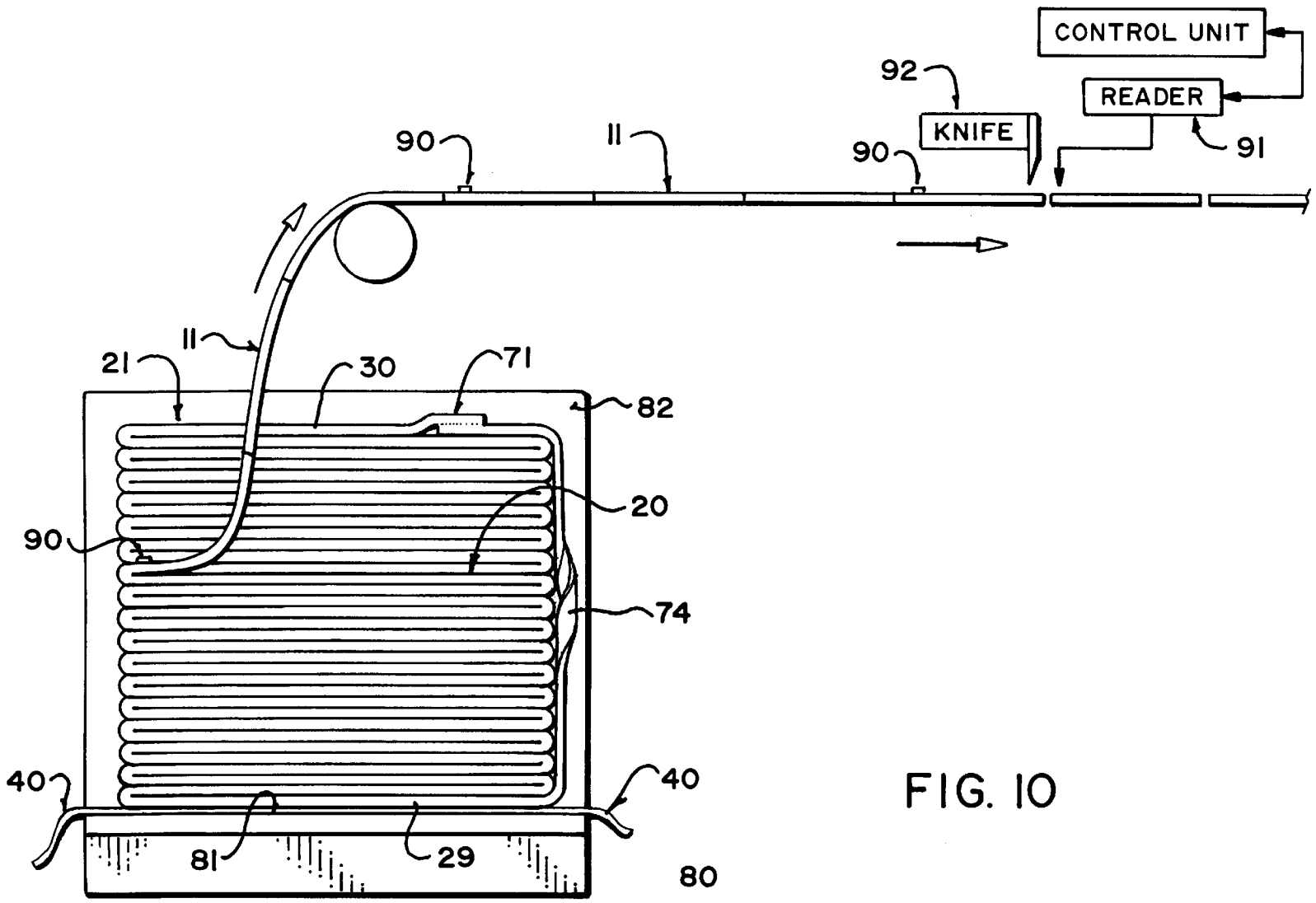
FIG. 10 is a side elevational view of the package of FIG. 9 showing further details of the strip and the subsequent cutting thereof into sheet portions.

It is preferable however that the package be oriented at least for unfolding so that the stacks remain vertical to supply the strip to the end use machine as shown in FIGS. 9 and 10. In this orientation the stacks 20, 21, 22 and 23 are all vertical and side by side so that the individual folded strip portions are horizontal from the horizontal top strip portion 30 of each of the stacks to a horizontal bottom strip portion 29 of each of the stacks. It is appreciated therefore that in this arrangement each stack will necessarily be unfolded in turn from the top strip portion 30 down to the bottom strip portion 29.

The initial structure of the package as shown in FIG. 1 includes the stacks formed side by side with the strip of each separate from the strip of the next This can be achieved in one arrangement by sliding a web into a plurality of side by side strips and by folding those strips simultaneously side by side using a carriage having a pair of nip rollers, The nip rollers lie in a horizontal plane and extend at right angles to the sides 16 and 17. The nip rollers are reciprocated on the carriage in a direction at right angles to their length so that the nip moves back and forth between the ends 18 and 19 to accurately lay down a measured strip length and to fold the strip portions at the fold lines 25, 26.

As shown in FIG. 1, the top end strip portion 30 of each stack 20 generally lays across the top of the stack and has the leading free end 44 at the end 18 which is draped down from the top 14 The end at the top of the stack 20 can be pulled out to form the leading end 12.

The bottom strip portion 29 includes a tail portion 45 which is pulled out from underneath the stack or is formed prior to the formation of the stack as a piece of the strip which hangs out from or beyond the side 18 of the package.

In some types of material and in some processes, it may be desirable to wrap the package structure as shown in FIG. 1 with the tails 45 not yet connected or spliced and simply free at the top of the packaging material for splicing after transportation and storage is completed. It will be appreciated that the package structure is stationary and therefore readily available for leisurely splicing when it has been moved to the machine to be supplied. Splicing can therefore be effected after the transportation and while the package is awaiting unfolding or even while the first stack 20 is being unfolded. The positioning of the tails 45 upwardly along the side of the package to a position at the top of the package makes the tails readily available so that the packaging material previously described can remain in place with simply the top portion of the packaging material or bag opened or removed to allow access to the top portions 44 and the top end of the tail portions 45.

As shown all of the tall portions 45 are arranged at the end 18 of the package. It is theoretically possible but practically undesirable that alternate ones of the tail portions are arranged at opposite ends 18 and 19 so that for example the tail portions 45 of the stacks 21 and 23 would be arranged at the end 19.

As shown in FIG. 2, preferably prior to transportation, the tail portions 45 are spliced to the top portions 44 by a splice 46. As the splice can be done without high speed action necessary, effective splicing systems can be used including stitching, taping and heat sealing which take more time than is generally available on a running line. The splices are shown overlapping but in practice, butt type slices may be used to prevent an overlap portion.

The splicing is effected such that the surface A of each strip is attached to the surface A of the strip of the next adjacent stack and similarly the surfaces B are also connected. In some cases this is essential as the strip has different surface characteristics. In other cases, this may not be essential to the processing of the strip but in general this is a preferred arrangement to ensure that the strip is supplied in a consistent manner and to avoid twisting of the strip.

In order to ensure that the strip remains without twist as it is unfolded, it is necessary to twist the tail portion 45 in a direction which counters the twist which is introduced into the strip as unfolding transfers from stack 20 to stack 21. Careful analysis of the strips and the process of unfolding will show that the transfer from one stack to the next automatically introduces one turn of twist. It is necessary therefore to counter this turn of twist by a single turn 47 of twist applied to the tail portion prior to splicing at the splice 46.

Preferably this turn of twist is applied at a first fold line 48 at a top of a first portion 50 and a second fold line 49 at a bottom of a portion 51. The first fold line 48 and the portion 50 are aligned with the stack 20 and the fold line 48 is arranged at an angle of 45° to the horizontal. This forms a horizontal portion 52 of the strip which extends from the fold line 48 to the fold line 49 and is therefore in effect horizontal and at right angles to the normal vertical direction of the tail portion 45 and the portions 50 and 51. The first fold line 48 causes the horizontal portion 52 to lie outside of the vertical portion 50 of the tall portion 45. The second fold line 49 is arranged so that the vertical portion 51 of the tall portion 45 is inside the horizontal portion 52. This arrangement introduces one turn of twist while minimising the length of the horizontal portion 52 and providing a tidy arrangement which is aesthetically attractive and which limits the loose parts available of the tail portion 45 which could otherwise interfere and inter-entangle.

The vertical portion 51 of the tail portion 46 then extends vertically up the stack 21 to the splice 46, from which the portion 44 continues up the side of the stack 21 and onto the top of the stack 21.

The horizontal portion 52 is preferably arranged at or immediately adjacent the bottom of the stack 20 so that almost all of the tail portion 45 is supported by the stack 21 as the stack 20 is withdrawn. There is therefore little or no possibility for the tail portion 45 becoming entangled with the strip from the stack 20 as it is withdrawn and prior to the transfer from the bottom portion 29 through the tail 45 to the top portion 44 of the stack 21.

In FIGS. 3, 4 and 5 is shown the same package structure as that of FIG. 2. In FIG. 3 the package is shown in a condition partly spliced so that only some of the tail portions 45 are connected to the associated portion 44 of the next stack. In FIG. 3, the package is shown in the same orientation as in FIG. 2 with the top 14 uppermost. The compression plates D1 and D2 therefore operate vertically. In FIGS. 4 and 5, the same package is rotated in the clamping plates D1 and D2 so that the plates are vertical and the end 18 is moved to the top. This places the tails 44 and 45 in a horizontal orientation to make easier the splicing and twisting since the tails remain in place supported by the horizontal end 18.

In FIG. 4, the package is in the condition prior to compression but after twisting and splicing with the bag 40 open. In FIG. 5 the package is in a compressed condition, maintained by the outer wrapping or bag 40. In this condition, the package height between the ends 14 and 15 is reduced from the rest height to a compressed height as shown which is a proportion of the rest height which varies depending upon the compressibility of the material.

This reduction in height leaves a free portion 54 of the connection portion 44, 45 which must be accommodated in the compression. This is achieved as shown in FIG. 5 by carefully folding the connection portion 44, 45 at a first transverse fold line 53 and at a second transverse fold line 53A both of which are substantially at right angles to the length and which are spaced by one half the length of the free portion 54.

Compression is effected mechanically in the direction D by the clamping plates D1 and D2 until the required reduction in height of the package is achieved. During this compression the connection portion 44, 45 becomes slack and the excess length portion 54 is formed. The folding action is effected manually and carefully so that the fold as shown in FIG. 2 lies on the respective stack aligned with the respective portion 44. When the compression is completed and the fold effected, the bag is closed and sealed using a conventional commercially available vacuum sealing system which seals the top edge of the bag and evacuates the bag. It is also possible that the vacuum extraction can be used to assist mechanical compression while the bag is left unsealed so that the bag can be opened to effect the careful folding action and sealed after the folding is complete. However the wrinkling of the tail 45 during vacuum extraction should be avoided.

A spacer member 58 is located between the connection portions 44, 45 and the end 18 containing the fold lines 25. It will be appreciated that the fold lines, even when significantly compressed, form an uneven surface with a series of transverse recesses and ribs defined by the actual fold lines themselves. It is important that the connection portions 44, 45 are maintained flat and are free from the wrinkles which would otherwise be formed should these connection portions be compressed by the vacuum from the bag (that is the air pressure outside the bag) onto the end 18.

The spacer member 58 therefore comprises a stiffener sheet 59 formed of a relatively stiff flat material defining a flat outer surface 60 which is attached to or carries a compressible filler material 61 on the underside, for example of a closed cell foam. The stiffener sheet can be formed of cardboard or similar material which has sufficient rigidity to remain substantially flat and thus define the flat surface 60 presented toward the connection portions. The compressible material or foam is arranged to fill the recesses between the fold lines and to compress at the fold lines so that the stiffener sheet can remain flat and is not compressed into the recesses.

The spacer member is inserted during the process at a suitable point prior to the vacuum action of the bag. This spacer member has a height equal to the compressed height of the package.

The spacer member can also be used in the situation previously described where the package is transported after compression and wrapping in the configuration shown in FIG. 1 where the spacer member is used to prevent wrinkling of the tail portions 44 and 45.

Figure 6:
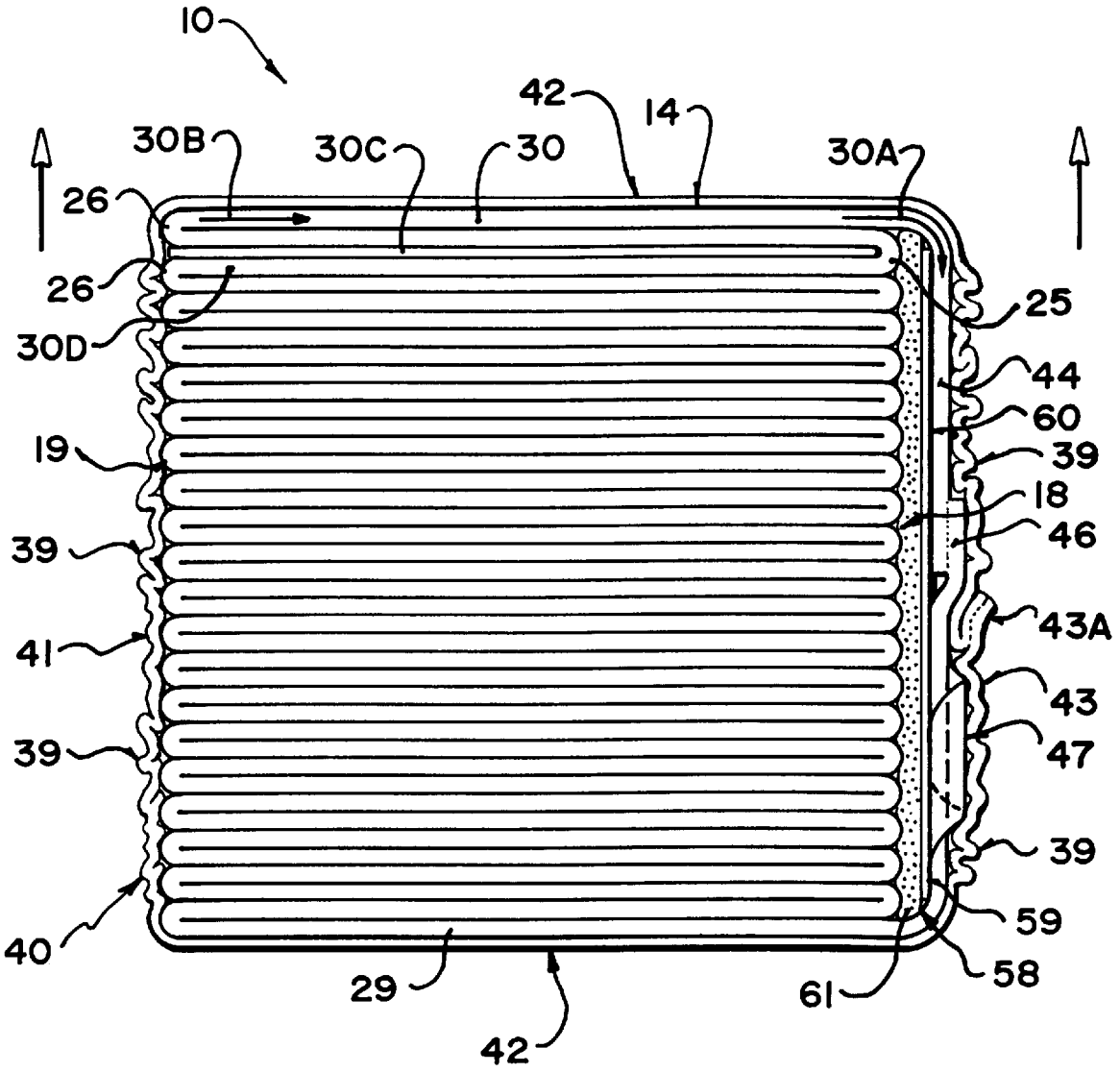
FIG. 6 is a cross-sectional view similar to that of FIG. 5 showing a modified arrangement of the connection portion with the package rotated for transportation and unfolding.

Turning now to FIG. 6, there is shown an alternative arrangement for the connecting portion which avoids the necessity for folding the connecting portion during compression. Thus the connecting portion extending from the tail portion 45 to the tail portion 44 is twisted as previously described to form a twist portion 47 and spliced to form a splice portion 46. In this arrangement, however, the splice is effected so that the connection portion is tight across the end 18 of the package with no fold corresponding to the fold 54 of FIG. 2. Thus in FIG. 6, the package is shown in the compressed condition with the bag sealed and under vacuum.

The package is shown in the in which the bottom end 15 rests upon a horizontal support and the top end 14 is presented upwardly. In this orientation the bag can be opened releasing the vacuum and allowing the package to expand back to its rest condition. During this expansion, the connection portion is of insufficient length to reach the rest height and therefore the excess length necessary to form an extended connection portion is effected by pulling from the top strip portion 30 as indicated at the arrow 30A and 30B.

In order to ensure that the top end strip portion 30 slides freely across the top end 14, there is provided a slip sheet 30C positioned between the top two strip portions and a third strip portion 30D. Thus the fold line 26 at the end 19 of the package is pulled in a direction of the arrow 30B and can be pulled away from the next adjacent fold line and the strip portion 30D without a tendency to pull with it the next strip portion 30D. The slip sheet can be formed of any suitable flexible low friction sheet of plastics or similar material. The slip sheet covers the wide area between the ends and the sides and thus separates the top two strip portions from the remainder of the package.

Figure 7:
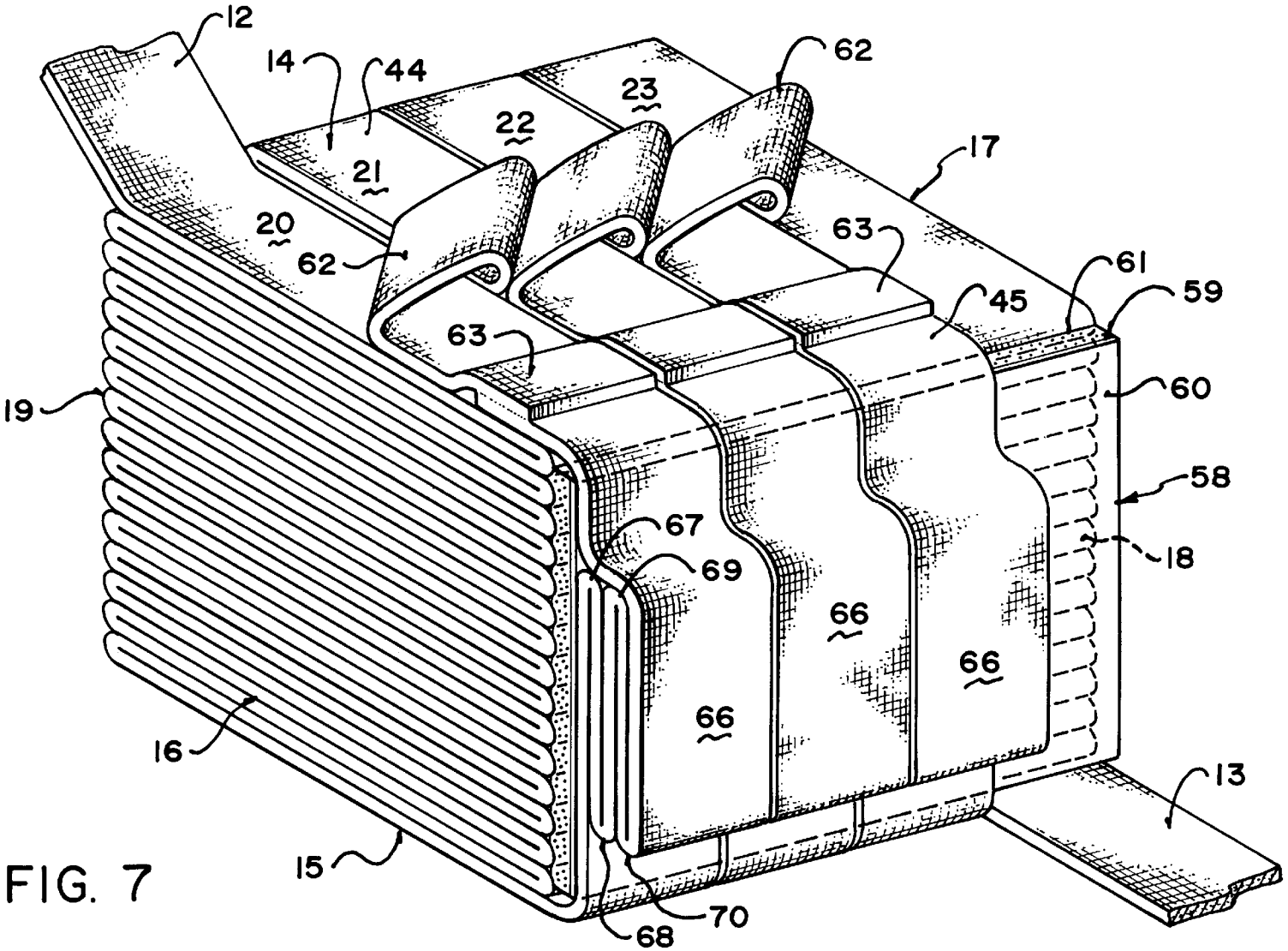
FIG. 7 is an isometric view similar to that of FIG. 2 showing a further modified arrangement of the connection portion.

Turning now to FIG. 7 there is shown an alternative arrangement for effecting the twisting, splicing and folding actions in the connection portions 44, 45. In this arrangement the package remains in the original orientation during processing so that the top 14 remains uppermost. In this orientation, prior to compression, the connection portion defined by the tails 44 and 45 is twisted to form a twist portion 62 as previously described and is spliced to form a splice portion 63 as previously described except that the twist and the splice are located on the top end 14. As these are effected on the horizontal top surface of the package, they can be effected manually without difficulty due to the support from the top end 14. The splice is effected so that the height of the tall 45 from the bottom of the package along the end of each stack is equal to the height of the package in the uncompressed condition.

With the package structure in the necessary wrapping bag, and with the bag having the open top facing to the end 18 of the package. The compression is effected as shown in FIG. 3 using the clamping plates D1 and D2. In order to prevent the sides of the package from being squeezed outwardly by the compression, a pair of side plates 64 and 65 support the sides of the package during the compression action. The bag is of course located inside the plates 64 and 65 underneath the clamping plate D1 and on top of the clamping plate D2.

With the package compressed, the length of the tail portion is greater than the compressed height of the package so that an excess portion is formed which is then carefully folded as shown in FIG. 7. In the situation where the compressed height is less than one half of the rest height, a multiple fold arrangement can be used to define the fold 66 including fold lines 67, 68, 69 and 70. The spacer plate 68 is located in position between the folds 66 and the tails 45 and the end 18 of the package.

Figure 8:
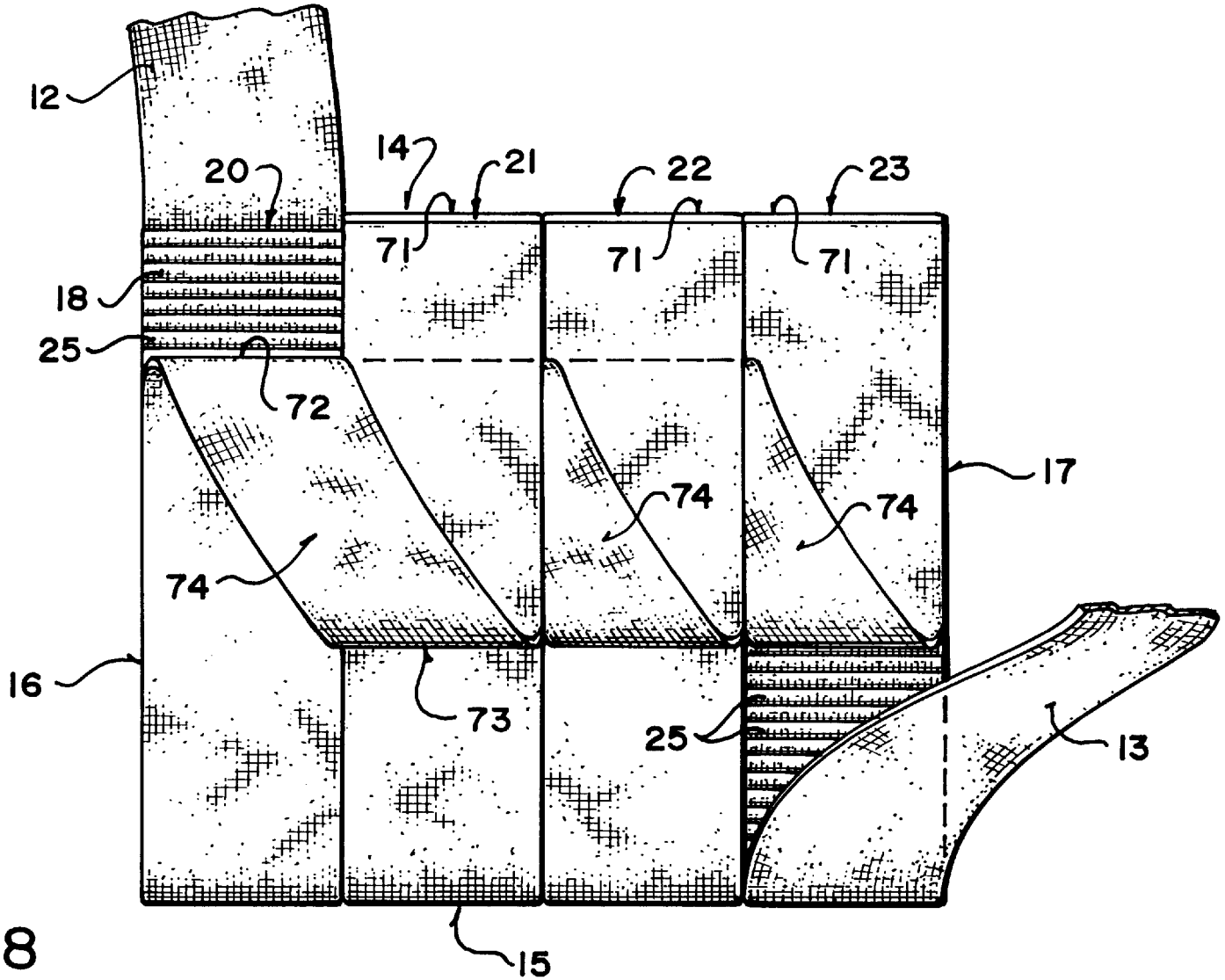
FIG. 8 is side elevational view of a package showing a yet further modified arrangement of the connection portion.

Turning now to FIG. 8 there is shown a yet further alternative technique for accommodating the necessary splice, twist and fold in the connection portion. In FIG. 8, therefore, the splice 71 is located on top of the top end 14 similarly to that arrangement in FIG. 7. However the twist and fold are located on the end 18 of the package and are combined into one element. Thus there is a first upper fold line 72 and a second fold line 73 which is in a direction which automatically twists the strip about its length to make the required single twist 74 at the same position as the fold portion. In effect therefore, the folding is an extended version of the fold in FIG. 2. This careful folding provides a clean attractive appearance and reduces the crinkling or creasing of the strip since the fold lines 72 and 73 are spaced by the length of the fold portion 74 and are close to transverse to the strip length.

Turning now to FIGS. 9 and 10, there is shown the technique for unfolding the packages previously formed and shown in FIGS. 2 to 8. The specific package illustrated is that shown in FIG. 8, but the position of the twist and splice have little or no effect on the unfolding operation as will be appreciated and therefore the packages shown in FIGS. 2 to 7 will operate in the same manner.

Thus, when the package is released from the compression, as shown in FIG. 9, the connecting portions fall into loose lengths with the twist 74 at some position along the length allowing the connecting portion to effect transfer of unfolding from one stack to the next. The bag 40 is cut away so that the top 43 and the sides 42 are removed leaving only the base 41, and a portion of the side draped over the surfaces 82. The spacer 58 is removed.

The package is laid on an unfold stand 80 for unfolding. This provides a generally horizontal main support surface 81 on which the stacks 20 to 23 stand upwardly in a generally upright manner for unfolding from the top downwards In addition the stand 80 includes a side support surface 82 at right angles to the surface 81. The stand is then inclined at a shallow angle of the order of 10 to 20 degrees which is just sufficient to tilt the package to one side so that the stack 23 leans against the surface 82 and the remaining stacks each rest on the next adjacent stack. The angle is just sufficient to prevent toppling or buckling of the stacks away from each other in a direction away from the surface 82.

It will be appreciated that the tendency of the package to slightly expand and the pulling on the first stack 20 will create the greatest tendency on the first stack 20 to topple while the others remain stable. The angle is therefore selected to prevent the possibility of toppling of the first stack and each subsequent stack as it becomes the first stack as the others are unfolded. The first stack 20 is thus available to be unfolded from the top downwardly, followed by each stack in turn. This arrangement has the advantage that no other support for the package sides is required and the package is stable in the position shown during unfolding. Also transfer of unfolding from one stack to the next can occur without frictional contact of the strip with packaging material or other support which can cause tearing of weaker material.

The strips are often used for cutting of the strip into a series of consecutive sheet elements each having a predetermined length. In order to prevent the fold lines from interfering with the effectiveness of the sheet elements, during folding of the stacks in the packaging system previously described, a marker (not shown) is located adjacent the packaging system for applying a machine readable marking 90 on the strip in registration with the fold lines. The markings can comprise an ink jet marking, possibly in the form of a dot or square, visible both to the eye and to the cutting machine or in some cases just to the machine. The marking may or may not be located directly at the fold line depending upon the location of the machine reader 91 relative to the cutting blade 92 which is therefore arranged to effect a cutting immediately at or adjacent to the fold line. In the example shown, the marking is located in advance of the fold line or the intended cut line. The marking may extend only across a short part of the width of the strip. It will be appreciated that as the markings are registered with respective ones of the fold lines, each marking is offset from its associated fold line by the same distance. In an arrangement in which only the fold lines are marked by the ink jet marking, there will be only one marking on each strip portion. In order to maintain the cut lines at the fold lines it is necessary that the number of sheet elements on each strip portion is exactly a whole number. In many cases, the relative lengths of the elements and the strip is such that the whole number is greater than one. Each intended cut line therefore can be marked or only the fold lines may be marked. The cut lines are therefore arranged so that the fold lines are arranged sufficiently close to an end of the sheet elements to avoid compromising the performance of the sheet elements.

Turning now to the arrangement shown in FIG. 11, a package formed from the same stacks as previously described is oriented so that the stacks are horizontal each on top of another so that they can be unfolded from the top stack downwardly. This can use the same splicing, twisting and folding arrangements as previously described. However a more simple splicing technique is available when the package is oriented in this manner. Thus, when wrapped, compressed and sealed, the package structure is oriented so that the stacks 20 to 23 are horizontal. In this orientation, the application of vertical loads onto the package from other packages causes the transfer through the package structure to an underlying pallet without distorting or damaging the strip. This occurs due to the fact that the strip is relatively stiff across its width and when compressed into the stacks, the strips together form a substantially rigid structure.

As shown in FIG. 11, the top stack 20 is partly unfolded from the leading end portion 12 toward a trailing end portion 94 of that stack at the end 14 of the package 10. The next stack 21 has the leading end portion 95 thereof at the same end 14 as the trailing end 94 and is connected by a connecting portion 96 including a splice 97 to the leading end 95 of the stack 21. The connecting portion 96 lies in the same plane as the end 14 and extends generally diagonally between the stacks 20 and 21.

In a symmetrical manner, the trailing end (not visible) of the stack 21 is connected to the leading end of the stack 22 by a connecting portion (not visible) including a splice. The trailing end of the stack 21, the connecting portion and the leading end of the stack 22 are all arranged at the end 15 of the package coplanar with the end 15.

A further connecting portion 98 and splice 99 at the end 14 interconnect the trailing end 100 of the stack 22 and the leading end 101 of the stack 23.

The connecting portions 96, 98 and any further connecting portions required for additional stacks are arranged at the end 14. The connecting portions for alternate stacks are arranged at the opposed end 15. The connecting portions are coplanar with the end portions of the strip and thus lie flat against the side of the package when completed and wrapped as described herein.

This orientation of the package used for unfolding the package is shown in FIG. 11. The bag remains in place to hold the end strip portions and the connecting portions in place but the top 43 is opened by removal or cutting of a small opening and the leading end 12 of the strip is found and pulled through the opening. By placing the package in this orientation, therefore, each stack in turn can be unwound without the danger of the stack toppling since it is lying on its side supported by the underlying stacks.

It will be noted that the splicing technique shown ensures that, when the strips are unfolded as shown in FIG. 11, no twist is applied to the strip as the unfolding transfers from one stack to the next. However, in order to ensure that side A of the strip of stack 20 is connected to side A of the strip of stack 21 (and the sides B are connected) it is necessary to reverse the strip in stack 21. Symmetrically the stack 22 has the same orientation as stack 20 and the stack 23 is reversed as stack 21. This reversal can be obtained by physically lifting the intermediate stacks and rotating them through 180 degrees about an axis at right angles to the stacks. The same effect can be achieved by twisting the strip through 180 degrees as it is fed to the folding system for simultaneous side by side folding as previously described. This twisting has the effect of placing the side A at the outside in the fold lines at the end 18 of the stacks 20 and 22 and placing the side B outside on the fold lines at the same end for the stacks 21 and 23.

In an alternative arrangement (not shown) the folding and compression technique as previously described can be used for a single stack of a strip. Such a strip can be relatively wide, for example a length of carpet or fabric which is folded back and forth, packaged in the bag, compressed and maintained compressed by the air pressure outside the evacuated bag.

The compression reduces the height of the stack to an extent such that the structure becomes rigid and free standing so as to protect the strip and allow easy handling.

In order to prevent inadvertent expansion of the package at inopportune moments during transportation, storage or handling due to puncturing of the bag and release of the vacuum, the bag may be further wrapped by a shrink wrap material or other material which will hold the package in the compressed condition.

In a further arrangement (not shown), the package can be formed by building each stack in turn from a single end of the strip so that the strip is continuous from each stack to the next without the necessity for splicing. This technique has the disadvantage that the building is relatively slow and requires a number of winding stations to take up a full width of a web from which the strips are slit.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of supplying a strip of material comprising:

providing a strip of material having a first side edge, a second side edge, a first surface and a second surface;

forming a package of the strip of material having two ends, two sides, a top and a bottom and comprising:

a plurality of stacks of the strip;

each stack comprising a plurality of folded portions of the strip, wherein each portion of the stack is folded relative to the next portion about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned and parallel to the sides of the package;

the stacks being parallel and arranged side by side so that the fold lines at one end of the stacks are arranged at one end of the package and the fold lines at the other end of the stacks are arranged at the other end of the package;

the strip being continuous through each stack from a bottom end portion of the strip at the bottom of the stack to a top end portion of the strip at the top of the stack;

compressing the package in a direction at right angles to the top and bottom of the package so as to decrease the height of the stacks from a rest height to a compressed height such that the package can be released from the compressed condition for supply of the strip;

after compressing the stacks, connecting by a spliced connecting portion the bottom end portion of at least one of the stacks to the top end portion of a next adjacent stack, the spliced connecting portion extending along one end of the package;

wherein the spliced connecting portion has a length which is less than the rest height;

releasing the package from compression for withdrawing the strip from the stacks in turn;

and, as the package is released from compression, causing the length of strip portion necessary to increase the length of the spliced connecting portion to the rest height to be drawn from the top two strip portions of the next adjacent stack.

2. The method according to claim 1 wherein the spliced connecting portion and the top end portion together define a strip portion which has inserted at some position along its length a 360 degree turn of twist.

3. The method according to claim 1 wherein the package is wrapped with a flexible packaging material comprising a closed bag from which air has been withdrawn which is sealed against ingress of air such that the stacks are maintained in the compressed condition and the stacks are held together by atmospheric pressure on the packaging material.

4. The method according to claim 3 including providing a spacer member between the end of the package and the spliced connecting portion, the spacer member having a flat surface facing outwardly of the end of the package contacting the spliced connecting portion so that the spliced connecting portion is maintained flat when the package is compressed.

5. The method according to claim 4 wherein the spacer member includes a stiffener sheet on a side thereof defining said flat surface and a compressible filler material on a side facing the end of the package for filling recesses between the fold lines.

6. The method according to claim 5 wherein the filler material is a closed cell foam.

7. The method according to claim 1 wherein there is provided a slip sheet underneath a second strip portion from the top to allow relative sliding movement of the top two strip portions relative to a third strip portion and the rest of the package as the package expands.

8. A method of supplying a strip of material comprising:

providing a strip of material having a first side edge, a second side edge, a first surface and a second surface;

forming a package of the strip of material having two ends, two sides, a top and a bottom and comprising:

a plurality of stacks of the strip;

each stack comprising a plurality of folded portions of the strip, wherein each portion of the stack is folded relative to the next portion about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned and parallel to the sides of the package;

the stacks being parallel and arranged side by side so that the fold lines at one end of the stacks are arranged at one end of the package and the fold lines at the other end of the stacks are arranged at the other end of the package;

the strip being continuous through each stack from a bottom end portion of the strip at the bottom of the stack to a top end portion of the strip at the top of the stack;

providing a connecting portion for connecting the bottom end portion of each stack, the connecting portion extending along one end of the stack;

compressing the package in a direction at right angles to the top and bottom of the package so as to decrease the height of the stacks from a rest height to a compressed height such that the package can be released from the compressed condition for supply of the strip;

wrapping the package with a flexible packaging material comprising a closed bag from which air has been withdrawn which is sealed against ingress of air such that the stacks are maintained in the compressed condition and the stacks are held together by atmospheric pressure on the packaging material;

and providing a spacer member between the end of the package and the connecting portion, the spacer member having a flat surface facing outwardly of the end of the package for contacting the connecting portion.

9. The method according to claim 8 wherein the spacer member includes a stiffener sheet on a side thereof defining said flat surface and a compressible filler material on a side facing the end of the package for filling recesses between the fold lines.

10. The method according to claim 9 wherein the filler material is a closed cell foam.

11. A method of supplying a strip of material comprising:

providing a strip of material having a first side edge, a second side edge, a first surface and a second surface;

forming a package of the strip of material having two ends, two sides, a top and a bottom and comprising:

a plurality of stacks of the strip;

each stack comprising a plurality of folded portions of the strip, wherein each portion of the stack is folded relative to the next portion about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned and parallel to the sides of the package;

the stacks being parallel and arranged side by side so that the fold lines at one end of the stacks are arranged at one end of the package and the fold lines at the other end of the stacks are arranged at the other end of the package;

the strip being continuous through each stack from a bottom end portion of the strip at the bottom of the stack to a top end portion of the strip at the top of the stack;

connecting by a spliced connecting portion the bottom end portion of each stack to the top end portion of a next adjacent stack, the spliced connecting portion extending along one end of the stack;

compressing the package in a direction at right angles to the top and bottom of the package so as to decrease the height of the stacks from a rest height to a compressed height such that the package can be released from the compressed condition for supply of the strip;

releasing the package from compression for withdrawing the strip from the stacks in turn;

the spliced connecting portion being arranged such that, as the package is released from compression, a length of strip portion necessary to increase the length of the spliced connecting portion to the rest height is drawn from two overlying strip portions;

wherein there is provided a slip sheet between the two overlying strip portions arranged to reduce friction between the two overlying strip portions to allow relative sliding movement between the two overlying strip portions as the package expands.

12. The method according to claim 11 wherein the slip sheet is arranged underneath a second strip portion from the top to allow relative sliding movement of the top two strip portions relative to a third strip portion and the rest of the package as the package expands.

13. A package of a strip of material having a first side edge, a second side edge, a first surface and a second surface, the package having two ends, two sides, a top and a bottom and comprising:

a plurality of stacks of the strip;

each stack comprising a plurality of folded portions of the strip, wherein each portion of the stack is folded relative to the next portion about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned and parallel to the sides of the package;

the stacks being parallel and arranged side by side so that the fold lines at one end of the stacks are arranged at one end of the package and the fold lines at the other end of the stacks are arranged at the other end of the package;

the strip being continuous through each stack from a bottom end portion of the strip at the bottom of the stack to a top end portion of the strip at the top of the stack;

the package being compressed in a direction at right angles to the top and bottom of the package so as to decrease the height of the stacks from a rest height to a compressed height such that the package can be released from the compressed condition for supply of the strip;

a spliced connecting portion connecting the bottom end portion of each stack to the top end portion of a next adjacent stack, the spliced connecting portion extending along one end of the package;

wherein the spliced connecting portion has a length which is less than the rest height.

14. The package according to claim 13 wherein the spliced connecting portion and the top end portion together define a strip portion which has inserted at some position along its length a 360 degree turn of twist.

15. The package according to claim 13 wrapped with a flexible packaging material comprising a closed bag from which air has been withdrawn which is sealed against ingress of air such that the stacks are maintained in the compressed condition and the stacks are held together by atmospheric pressure on the packaging material.

16. The package according to claim 15 including a spacer member between the end of the package and the spliced connecting portion, the spacer member having a flat surface facing outwardly of the end of the package contacting the spliced connecting portion.

17. The package according to claim 16 wherein the spacer member includes stiffener sheet on a side thereof defining said flat surface and a compressible filler material on a side facing the end of the package for filling recesses between the fold lines.

18. The package according to claim 17 wherein the filler material is a closed cell foam.

19. The package according to claim 13 wherein there is provided a slip sheet between two strip portions arranged to reduce friction between the two strip portions to allow relative sliding movement between the strip portions as the package expands.

20. The package according to claim 19 wherein the slip sheet is arranged underneath a second strip portion from the top and on top of a third strip portion.

21. A package of a strip of material having a first side edge, a second side edge, a first surface and a second surface, the package having two ends, two sides, a top and a bottom and comprising:

a plurality of stacks of the strip;

each stack comprising a plurality of folded portions of the strip, wherein each portion of the stack is folded relative to the next portion about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned and parallel to the sides of the package;

the stacks being parallel and arranged side by side so that the fold lines at one end of the stacks are arranged at one end of the package and the fold lines at the other end of the stacks are arranged at the other end of the package;

the strip being continuous through each stack from a bottom end portion of the strip at the bottom of the stack to a top end portion of the strip at the top of the stack;

a connecting portion for connecting the bottom end portion of each stack, the connecting portion extending along one end of the stack;

the package being compressed in a direction at right angles to the top and bottom of the package so as to decrease the height of the stacks from a rest height to a compressed height such that the package can be released from the compressed condition for supply of the strip;

the package being wrapped with a flexible packaging material comprising a closed bag from which air has been withdrawn which is sealed against ingress of air such that the stacks are maintained in the compressed condition and the stacks are held together by atmospheric pressure on the packaging material;

and a spacer member between the end of the package and the connecting portion, the spacer member having a flat surface facing outwardly of the end of the package contacting the connecting portion.

22. The package according to claim 21 wherein the spacer member includes a stiffener sheet on a side thereof defining said flat surface and a compressible filler material on a side facing the end of the package for filling recesses between the fold lines.

23. The package according to claim 22 wherein the filler material is a closed cell foam.

24. A package of a strip of material having a first side edge, a second side edge, a first surface and a second surface, the package having two ends, two sides, a top and a bottom and comprising:

a plurality of stacks of the strip;

each stack comprising a plurality of folded portions of the strip, wherein each portion of the stack is folded relative to the next portion about a line transverse to the strip;

such that the first surface of each portion lies directly in contact with the first surface of a next adjacent portion and the second surface of each portion lies directly in contact with the second surface of a next adjacent portion; and such that the first side edges of the portions are aligned and also the second side edges of the portions are aligned and parallel to the sides of the package;

the stacks being parallel and arranged side by side so that the fold lines at one end of the stacks are arranged at one end of the package and the fold lines at the other end of the stacks are arranged at the other end of the package;

the strip being continuous through each stack from a bottom end portion of the strip at the bottom of the stack to a top end portion of the strip at the top of the stack;

a spliced connecting portion connecting the bottom end portion of each stack to the top end portion of a next adjacent stack, the spliced connecting portion extending along one end of the stack;

the package being compressed in a direction at right angles to the top and bottom of the package so as to decrease the height of the stacks from a rest height to a compressed height such that the package can be released from the compressed condition for supply of the strip;

the spliced connecting portion being arranged such that, as the package is released from compression, a length of strip portion necessary to increase the length of the spliced connecting portion to the rest height is drawn from two overlying strip portions;

wherein there is provided a slip sheet between the two overlying strip portions arranged to reduce friction between the two overlying strip portions to allow relative sliding movement between the two overlying strip portions as the package expands.

25. The package according to claim 24 wherein the slip sheet is arranged underneath a second strip portion from the top and on top of a third strip portion.

* * * * *